US005502932A

United States Patent [19]

Lu

[11] Patent Number: 5,502,932

[45] Date of Patent: Apr. 2, 1996

[54] METHOD AND DEVICE OF EARTHQUAKE RESISTANT & ENERGY REDUCTION FOR HIGH-RISE STRUCTURES

[75] Inventor: Jian-Heng Lu, Guizhou Providence, China

[73] Assignee: Chinese Building Technology Services Corporation Limited, Kowloon, Hong Kong

[21] Appl. No.: 122,306

[22] Filed: Sep. 17, 1993

Related U.S. Application Data

[63] Continuation of Ser. No. 831,987, Feb. 6, 1992, abandoned.

[51] Int. Cl.[6] ..... E04H 9/02

[52] U.S. Cl. ..... 52/167.9; 52/167.7; 52/167.1; 52/741.3

[58] Field of Search ..... 52/167 R, 167 RM, 52/167 E, 167 EA, 167 T, 741.3, 167.1, 167.4–167.9

[56] References Cited

U.S. PATENT DOCUMENTS

| | | | |
|---|---|---|---|
| 3,105,252 | 10/1963 | Milk | 52/167 RM X |
| 3,638,377 | 2/1972 | Caspe | 52/167 RM |
| 4,553,792 | 11/1985 | Reeve | 52/167 X |
| 4,554,767 | 11/1985 | Ikonomou | 52/167 T |
| 4,593,502 | 6/1986 | Buckle | 52/167 E |
| 4,599,834 | 7/1986 | Fujimoto | 52/167 EA |
| 4,727,695 | 3/1988 | Kemeny | 52/167 EA |
| 4,875,314 | 10/1989 | Boilen | 52/167 R |

FOREIGN PATENT DOCUMENTS

| | | |
|---|---|---|
| 9609 | 5/1991 | China . |
| 12214 | 12/1991 | China . |

*Primary Examiner*—Robert J. Canfield

*Attorney, Agent, or Firm*—Armstrong, Westerman, Hattori, McLeland & Naughton

[57] ABSTRACT

The "METHOD AND DEVICE OF EARTHQUAKE REST-STANT NAD ENERGY REDUCTION FOR HIGH-RISE STRUCTURES" includes a methed and device that is applicable to all kinds of high-rise structures and multi-storey buildings to resist earthquake and reduce energy generated from any horizontal force. The method employs horizontally placed sliding plates to divide the super-structure into a plurality of independent rigid structures. Each indepent rigid structure shall be connected to its upper or lower independent rigid structure with long bolts and nuts. The recess/hole that was inserted with long bolts shall be filled with rubber filler which acted as an buffer elastic isolator. Further, elastic recovery device shall be installed between each independent rigid structures and the rigid core structure which can be in the form of lift shaft, shear wall or any other similar structure. The device of the present invention includes one or more sliding plates, a plurality of long bolts, nuts, washers, resilient liners, buffer elastic isolators and elastic recovery edvices. This invention is applicable to all kinds of high-rise structures of multi-storey buildings for resisting earthquake and reduction of energy.

12 Claims, 3 Drawing Sheets

METHOD AND DEVICE OF EARTHQUAKE RESISTANT & ENERGY REDUCTION FOR HIGH-RISE STRUCTURES

This application is a continuation of application Ser. No. 07/831,987, filed Feb. 6, 1992 now abandoned.

FIELD OF THE INVENTION

This invention relates to the method and device of earthquake resistant and energy reduction for high-rise structures (hereafter termed as MDERER). The method and device falls within the scope of building or civil engineering. It is applicable to multi-story and high-rise buildings or any other type of high-rise structures. Its main function is to resist or absorb earthquake energy while the structure is under earthquake loading and to reduce energy while the structure is under horizontal loading (e.g. wind load). In general, the invention reduces energy through friction generated from relative movements while the structure is subjected to any type of superimposed horizontal loading.

BACKGROUND OF THE INVENTION

A building usually consists of three major portions i.e. the foundation, the sub-structure and the super-structure. All loading of the building transfers from the super-structure to the sub-structure and eventually to the foundation. When the traditional high-rise building is under earthquake loading or wind loading, the dynamic response of the high-rise building will have the following behaviour:

1. When the structure is under earthquake loading only, the resonance effect due to the dynamic response and the interaction of the super-structure, the sub-structure, the foundation and the foundation soil produces an exceptionally large shear to the structure and causes damage or even failure. The structure fails, in accordance with many studies, due to inadequate connection between the super structure and the sub-structure, and/or between the sub-structure and the foundation, and/or failure of subsoil.
2. When the structure is under wind loading, the accumulated wind load induces very large shear force to the structure. The structure is required to be very rigidly designed to withstand the strong shear induced.
3. When the structure is under both earthquake and wind loading, a resonance effect will induce extremely large shear.

It is generally noted that it is virtually impossible to analyse the stress distribution diagram for case 1 and 3. However, the stress distribution for case 2 can be determined. It is, therefore, necessary for contemporary design of the high-rise structure to be in a very rigid state and consequently increase the building investment.

Mr. Lu Jien-heng, the inventor of the MDERER, has disclosed the "Building Earthquake Restraint Device (BERD)" (China Patent Application No. 87100151.9) and the "Building Earthquake Elimination Device (BEED)" (China Patent No. 1036424). The BERD and BEED are devices used to increase earthquake resistance in respect of a sub-structure and foundation. However, the BERD and BEED have no energy reduction effect when the super-structure is subjected to horizontal loading. The cross sectional area of the structural components and the amount of reinforcement increase with the increase of the total height of the structure. It is necessary to resolve the earthquake resistance and the energy reduction problem for the multi-story building or high-rise structure so as to reduce the complexity of the stress distribution and subsequently reduce the building investment.

The object of this invention is to resolve the above mentioned problems and provide a method and device to resist earthquakes and reduce energy for all kinds of high-rise structures.

SUMMARY OF THE INVENTION

The method of this invention is to divide the super-structure into two or more independent rigid structures that vertically interact with each other by using one or a plurality of sliding plate(s). Any two adjacent independent rigid structures shall be connected by means of long bolts at a number of locations. Washers shall be placed between the independent rigid structure and the long bolts or nuts. An additional resilient liner 9 shall be placed between the independent rigid structure and the nut. The resilient liners 9 can be made of rubber, nylon or any other kind of elastic material. The clearance between the bolt and the recess hole (for placing the bolt) shall be closely filled with buffer elastic isolators.

Further, the core structure, i.e. the shear wall, the lift shaft or any other similar structure shall be designed as an integral rigid structure and shall not be divided by the sliding plate. Elastic recovery devices shall be installed between the independent rigid structures and the core structure. These devices shall be used to absorb part of the energy and to assist the independent rigid structures to recover to their original position.

The device of this invention is characterized in that it includes one or a plurality of sliding plate(s), a plurality of long bolts, a plurality of nuts, a plurality of washers, a plurality of resilient liners, a plurality of buffer elastic isolators and a plurality of elastic recovery devices.

The said sliding plate(s) is(are) used to divide the structure into two or more independent rigid structures. The said independent rigid structure is connected to its vertically adjacent (upper or lower) independent rigid structure by means of long bolts and nuts. The said long bolts and nuts shall be complete with washers. The said buffer elastic isolators shall be placed between the long bolt and the independent rigid structure at the recess hole for the bolt. The clearance between the bolt and the recess hole shall be closely filled with buffer elastic isolators. The said elastic recovery device shall be installed between the core structure and the independent rigid structures.

The said sliding plate shall be made with high strength PTFE or any other anti-corrosive high-strength material. The washer shall be a rubber washer or of any other similar material like nylon, etc. The said buffer elastic isolators shall be of rubber or any other similar material. The said elastic recovery device shall be a steel spring or of any other material having a similar character.

DETAILED DESCRIPTION OF THE PREFERRED EMBODIMENT

A detailed description of the MDERER now will be illustrated with reference to the following drawings.

Figure 1:
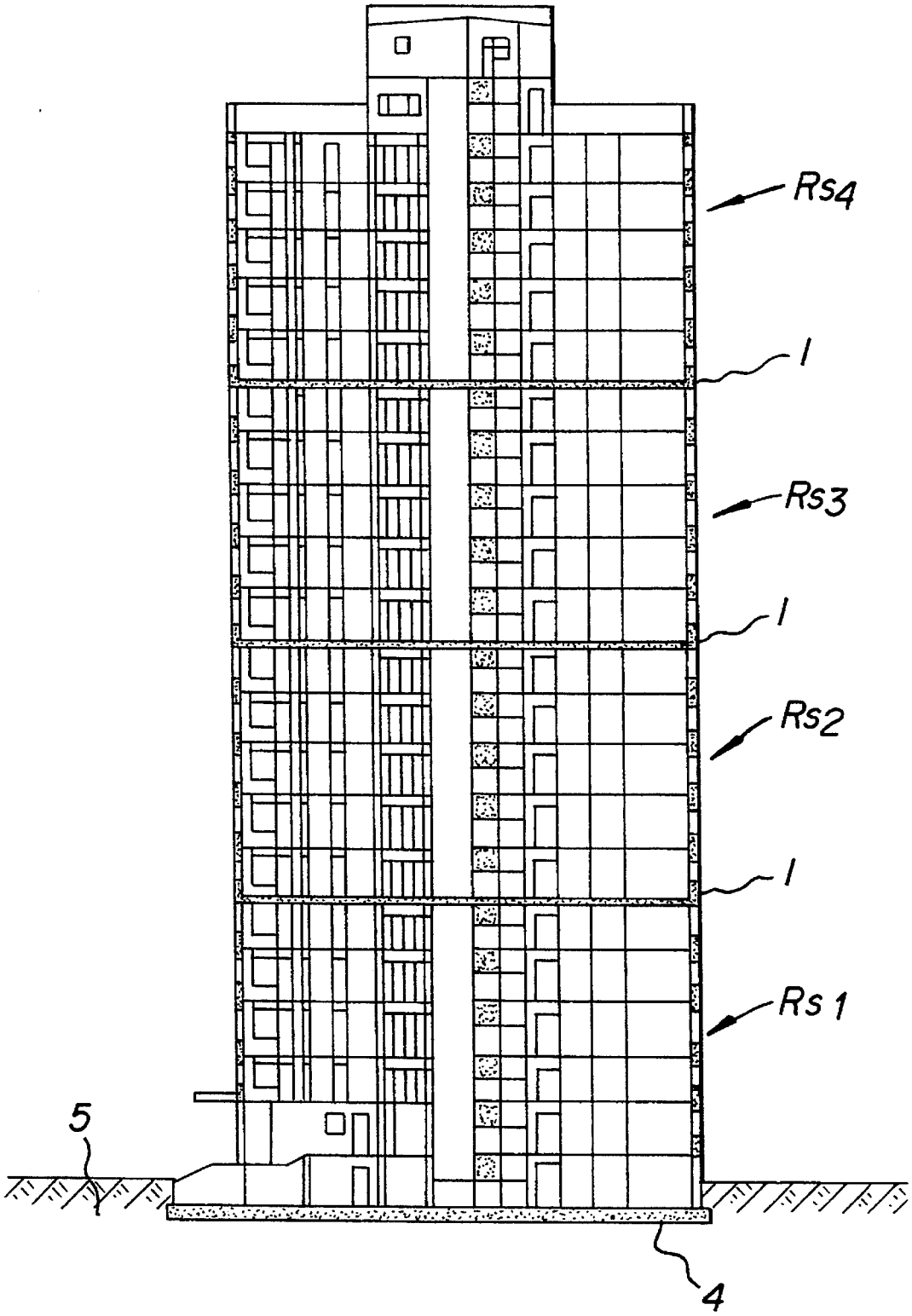
FIG. 1 shows the elevation (front view) of a high-rise building using the device of the present invention.

FIG. 1 shows the high-rise building employing the device of the present invention. The sliding plates defined as part of the device divide the entire structure into four independent rigid structures Rs1, Rs2, Rs3 and Rs4. These four independent rigid structures form the superstructure of the building. The building also includes the sub-structure that transfers the horizontal loading to the foundation 5.

Figure 2:
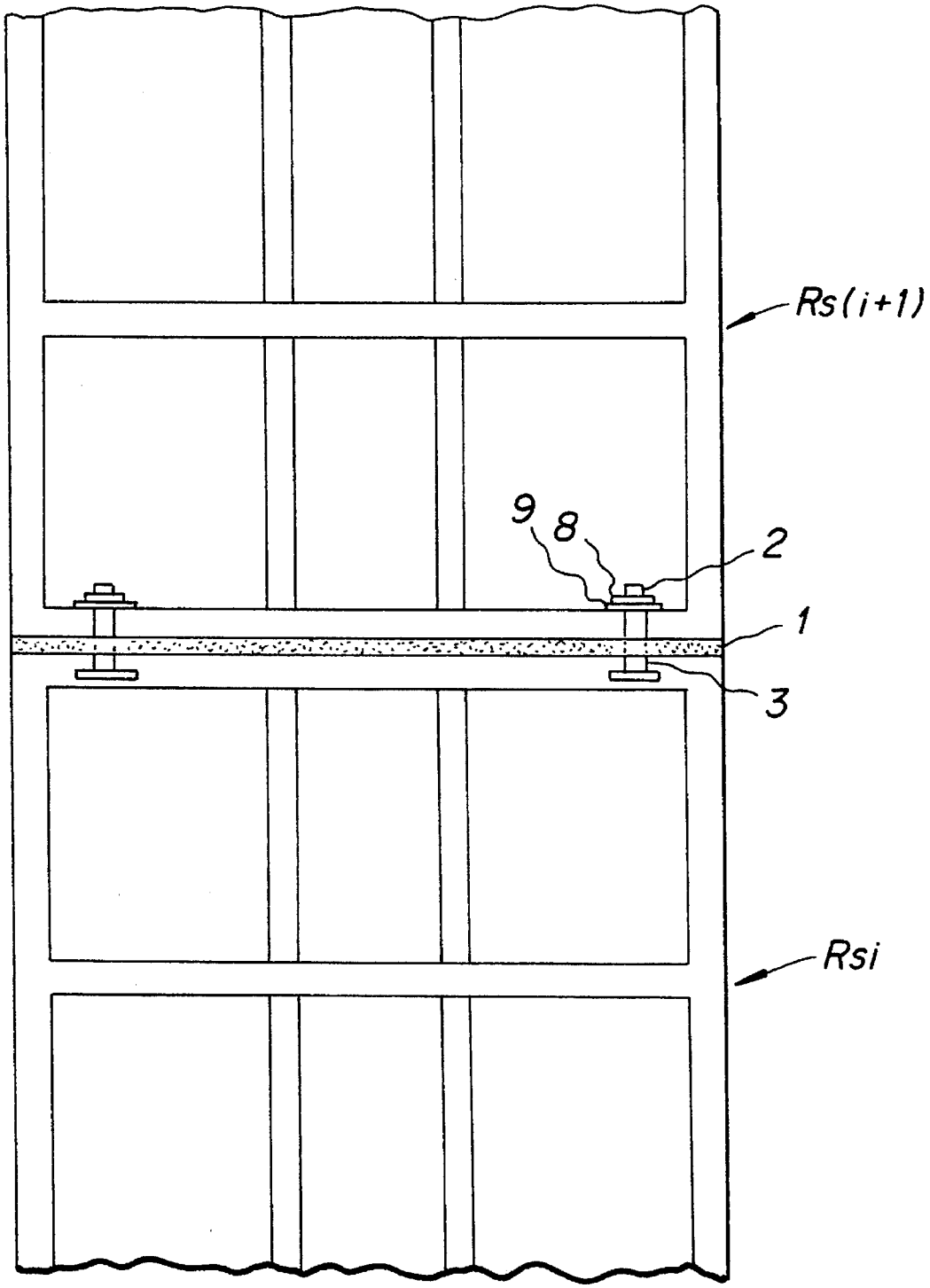
FIG. 2 is the elevation (cross sectional) view of the high-rise building shying parts of the device of the present invention.
Figure 4:
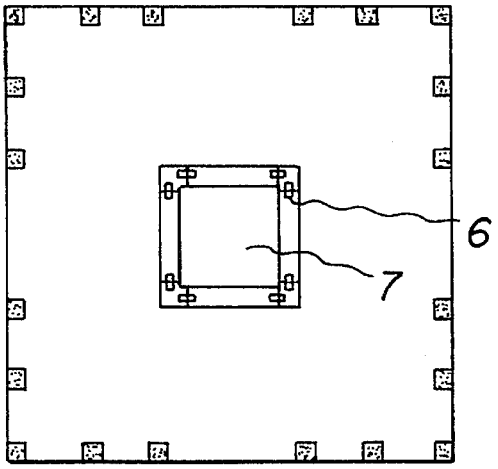
FIG. 4 is a top view corresponding to FIG. 3.

FIG. 2 shows that there are two vertically interacted independent rigid structures Rsi and Rs(i+1). Between these two structures, parts of the device of the present invention, i.e. the sliding plate 1, long bolts & nuts 2, and the buffer elastic isolators 3, for example, rubber fillers, are installed. Washers 8 are placed between the long bolts and nuts 2 and independent rigid structure Rs(i+1).

Figure 3:
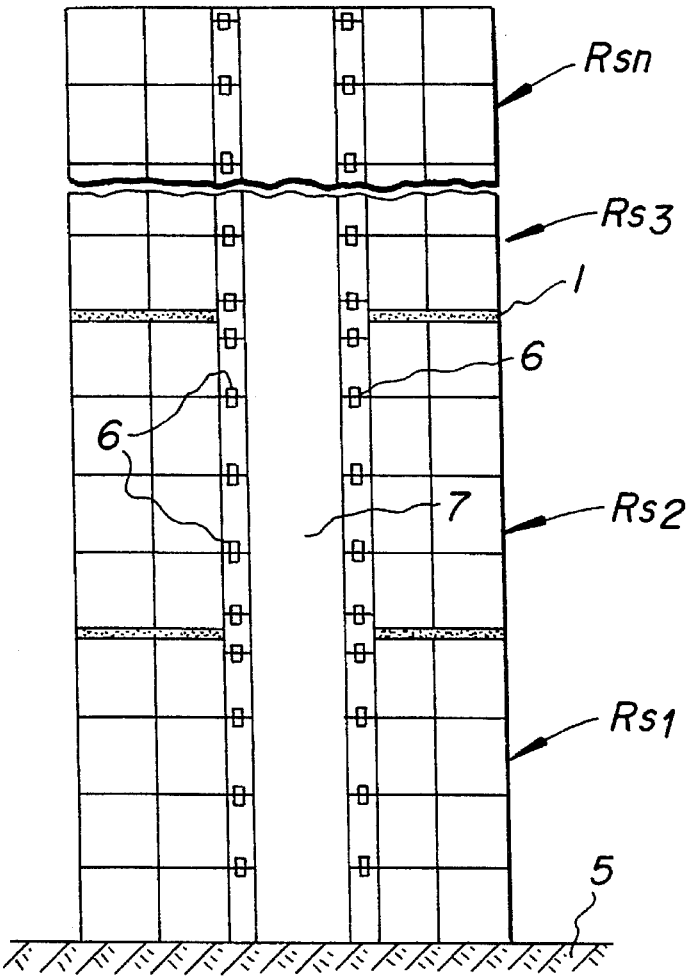
FIG. 3 shows the elevation and the cross section of a high-rise building that is built with a core structure. It also shows elastic recovery devices that are installed between the core structures and the independent rigid structure.

FIG. 3 shows a typical core structure which is designed to take the residual horizontal loading from the independent rigid structure after part of the horizontal loading energy is released through relative movement between the independent rigid structures. The core structure 7 can be a lift shaft, shear wall or any other similar structure. The elastic recovery devices, which are parts of the device of the present invention, are installed between the core structure and the independent rigid structures which are divided as shown in FIG. 1. The sliding plate can be made with high strength PTFE and can also be made with any other anti-corrosive high-strength material.

The core structure is one of the essential elements of the device of the present invention. As illustrated in FIG. 3, the core structure can be in the form of a lift shaft, shear wall or any other similar structure within the building. The core structure must be rigidly designed as an integral unit and shall not be divided by any sliding plate. In order to absorb the horizontal loading energy and provide the recovery effect, elastic recovery devices shall be installed between the core wall and the independent rigid structures. One end of the elastic recovery device shall be anchored into the wall of the core structure and the other end anchored into the independent rigid structure. As shown in FIG. 3, the elastic recovery devices 6 are connected to the core wall 7 and also to the independent rigid structure Rsi. The elastic recovery devices can be made by steel spring or any other elastic material that can provide the similar effect.

When a high-rise structure is subjected to horizontal loading e.g. wind load, each independent rigid structure has a tendency of incurring relative movement between the adjacent independent rigid structures. Any movement incurred will induce friction and hence part of the energy will be released. When movement of the independent rigid structures continues, buffer elastic isolators, e.g., the rubber filler, will be compressed and the long bolts will be subjected to bending which again will absorb part of the remaining energy. All the horizontal loads that act upon the independent rigid structures will be transferred into energy and released through friction loss when there is relative movement between the independent rigid structures or stored as potential energy when the rubber filler is compressed or the long bolts are bent. Due to the fact mentioned-above, the oscillation of the high-rise building will be reduced to a minimum.

The high-rise structure that employs MDERER differs fundamentally in its mechanical response from the conventional high-rise structure. The conventionally designed structure restrains the energy generated from the horizontal loading acting upon the structure, therefore the structure has to be very rigidly built. A small portion of the energy can be released through oscillation of the building and the remaining energy restrained within the structure and transferred to the foundation. When the horizontal force continues to be applied to the structure, like earthquake loading, the resonance effect will cause failure to the structure. This newly developed method and device i.e. the MDERER releases the energy generated from horizontal loading and reduces the possibility of damage to the structure.

The main function of the MDERER is achieved through the following:-

- the sliding plate(s) 1 as shown in FIG. 1 divide(s) the structure into a plurality of independent rigid structures and allow each independent rigid structure to have relative movement so as to release energy through friction loss; and
- the long bolts and nuts 2 as shown in FIG. 2, the buffer elastic isolators 3 as shown in FIG. 2 and the elastic recovery device 6 shown in FIG. 3 also absorb (reduce) part of the energy.

The thickness of the sliding plates are determined in accordance with the loading of each independent rigid structure.

The diameter and the material used for the long bolts and the thickness of the buffer elastic isolator, e.g. the rubber filler and the rigidity of the elastic recovery devices are main factors in considering the ability in absorbing the energy. These factors are determined according to the horizontal loading taken by each independent rigid structure and the permissible relative movement of each independent rigid structure. As each independent rigid structure is structurally independent, the stress distribution of each independent rigid structure, when subject to external loading, depends upon the layout and the size of the structure's members and also depends upon the number and the layout of the bolts. Hence the design of the independent rigid structures is simplified and each independent rigid structure can have a different layout as required. Further, the bolts transfer only vertical loads to the next independent rigid structure and no bending is required to be considered, this makes the stress distribution within the entire structure very simple. The utilization of the columns becomes more effective and reduces the dead weight of the structure. Also, structural analysis becomes simple and accurate and the behaviour of the structure can be predicted.

The device of the present invention is applicable to any type of high-rise structure or multi-story building. The device can be used in conjunction with the BEED and BERD which are patented in China and will increase the ability of the structures to resist earthquake and wind load.

What is claimed is:

1. A method of forming an earthquake resistant and energy reduction multi-level structure, comprising:

forming a building by providing at least one sliding plate having through holes at a plurality of locations, said at least one sliding plate located to divide a superstructure of the building into a plurality of independent rigid structures that interact vertically with each other;

connecting two adjacent independent rigid structures by long bolts disposed in the holes, washers and nuts;

placing a resilient liner between at least part of one independent rigid structure of said two adjacent independent rigid structures and said washers; and filling the holes in which said long bolts are disposed with a buffer elastic isolator.

2. A method of forming an earthquake resistant and energy reduction multi-level structure having a core structure, comprising:

forming an integral rigid core structure that bears horizontal loading;

providing at least one sliding plate with through holes at a plurality of locations to divide a superstructure of the multi-level structure into a plurality of independent rigid structures that interact vertically with each other;

connecting two adjacent independent rigid structures by long bolts disposed in the holes, washers and nuts;

placing a resilient liner between at least part of one independent rigid structure of said two adjacent independent rigid structures and said washers;

filling the holes in which said long bolts are disposed with a buffer elastic isolator; and installing elastic recovery devices between said core structure and each of said independent rigid structures each device having a first end connected to said core structure and a second end connected to at least one of said independent rigid structures.

3. An earthquake resistant and energy reduction multi-level structure comprising:

a superstructure, at least one sliding plate with through holes at a number of locations, a plurality of long bolts, a plurality of nuts, a plurality of washers, a plurality of resilient liners, a plurality of buffer elastic isolators, wherein said at least one sliding plate divides said superstructure into two or more independent rigid structures, said independent rigid structures being connected to a vertically adjacent independent rigid structure by means of said plurality of long bolts disposed in the holes and said plurality of nuts, each of said plurality of bolts and said plurality of nuts having respective washers and resilient liners at the nut end, a clearance between said long bolts and the holes of said plate being filled with said buffer elastic isolators.

4. An earthquake resistant and energy reduction multi-level structure comprising:

a superstructure, including an integral core structure, at least one sliding plate with through holes at a number of locations, a plurality of long bolts, a plurality of nuts, a plurality of washers, a plurality of resilient liners, a plurality of buffer elastic isolators, and, a plurality of elastic recovery devices, wherein said sliding plate divides said superstructure into two or more independent rigid structures, said independent rigid structures being connected to a corresponding vertically adjacent independent rigid structure by means of said long bolts and nuts, said bolts and nuts having washers and resilient liners at the nut end, a clearance between said long bolts and the holes of said plate being filled with said buffer elastic isolators, and wherein said elastic recovery devices are installed between said independent rigid structures and said core structure, each of said plastic recovery devices having a first end connected to the core structure and a second end connected to one of said independent rigid structures.

5. The earthquake resistant and energy reduction multi-level structure as claimed in claim 3, wherein said at least one sliding plate is made of high strength PTFE.

6. The earthquake resistant and energy reduction multi-level structure as claimed in claim 3, wherein said at least one sliding plate is made of an anti-corrosive high strength elastic material.

7. The earthquake resistant and energy reduction multi-level structure as claimed in claim 3 or 4, wherein said plurality of resilient liners are made of an elastic material.

8. The earthquake resistant and energy reduction multi-level structure as claimed in claim 3 or 4, wherein said plurality of buffer elastic isolators include a material that has a high elastic property.

9. The earthquake resistant and energy reduction multi-level structure as claimed in claim 4, wherein said plurality of elastic recovery devices include an elastic material.

10. The earthquake resistant and energy reduction multi-level structure as claimed in claim 4, wherein said plurality of elastic recovery devices include a steel spring.

11. The earthquake resistant and energy reduction multi-level structure as claimed in claim 7, wherein said elastic material is nylon or rubber.

12. The earthquake resistant and energy reduction multi-level structure as claimed in claim 8, wherein the material is nylon or rubber.

* * * * *

UNITED STATES PATENT AND TRADEMARK OFFICE

CERTIFICATE OF CORRECTION

PATENT NO.: 5,502,932
DATED : April 2, 1996
INVENTOR(S): Jian-Heng Lu

It is certified that error appears in the above-identified patent and that said Letters Patent is hereby corrected as shown below:

On the title page, Item [75], "Providence" should read --Province--.

In the Abstract, line 3 from the bottom, change "edvices" to --devices--.

In column 2, line 66, change "shying" to --showing--.

Signed and Sealed this
Twenty-eighth Day of January, 1997

*Attest:*

BRUCE LEHMAN

*Attesting Officer* *Commissioner of Patents and Trademarks*